US006535700B1

(12) United States Patent
Caruthers

(10) Patent No.: US 6,535,700 B1
(45) Date of Patent: Mar. 18, 2003

(54) LIQUID XEROGRAPHIC DEVELOPABILITY SENSOR

(75) Inventor: Edward B. Caruthers, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/704,709

(22) Filed: Nov. 3, 2000

(51) Int. Cl.[7] ..... G03G 15/10; G03G 15/08
(52) U.S. Cl. ..... 399/57; 399/29
(58) Field of Search ..... 399/27, 29, 30, 399/57, 58, 61, 62, 63, 64

(56) References Cited

U.S. PATENT DOCUMENTS

| | | | | | |
|---|---|---|---|---|---|
| 4,008,612 | A | * | 2/1977 | Nagaoka et al. | 399/57 X |
| 4,204,766 | A | * | 5/1980 | Harada | 399/57 X |
| 4,257,347 | A | * | 3/1981 | Stahl | 399/57 |
| 4,310,238 | A | * | 1/1982 | Mochizuki et al. | 399/64 |
| 4,860,924 | A | * | 8/1989 | Simms et al. | 399/57 |
| 5,995,778 | A | * | 11/1999 | Yamaguchi | 399/61 |
| 6,128,450 | A | * | 10/2000 | Suetsugu | 399/58 |

FOREIGN PATENT DOCUMENTS

JP 11-065297 * 3/1999

OTHER PUBLICATIONS

E. B. Caruthers, et al., "Liquid Toner Particle Charging and Charge Director Ionization," IS&T's Tenth International Congress on Advances and Non–Impact Printing Technologies.

E. B. Caruthers, et al., "Modeling of Liquid Toner Electrical Characteristics," 1994, IS&T's Tenth International Congress on Advances and Non–Impact Printing Technologies.

* cited by examiner

*Primary Examiner*—Sandra Brase
(74) *Attorney, Agent, or Firm*—Oliff & Berridge, PLC.

(57) ABSTRACT

A toner developability sensor and method sense toner developability of liquid ink in an ink reservoir of a liquid ink image forming system. The toner developability sensor includes a power supply, a first electrode having at least one surface in contact with the liquid ink and connected to the power supply, and a second electrode spaced from the first electrode. When a potential difference is applied between the first and second electrodes, a developed toner layer is formed on the first electrode. A sensor senses at least one characteristic of the developed toner layer formed on the first electrode. The sensor detects characteristics of the developed toner layer that are directly related to the developability of the toner.

25 Claims, 5 Drawing Sheets

LIQUID XEROGRAPHIC DEVELOPABILITY SENSOR

BACKGROUND OF THE INVENTION

1. Field of Invention

This invention is related to developing images using liquid toners.

2. Description of Related Art

An electrostatographic printing system uses a substantially uniformly charged photoreceptive member that is exposed to a light image of an original input document. The light image discharges selective areas of the photoreceptive member, forming an electrostatic latent image on the photoreceptive member. The electrostatic latent image is developed into a visible image by applying charged toner particles to the latent image. The developed image is transferred from the photoreceptive member to a copy substrate. The photoreceptive member is then cleaned to remove any residual charge or developing material.

In liquid electrophoretic image forming systems, the charged toner particles are part of a liquid developer material that is brought into contact with the latent image. The liquid developer material comprises charged toner particles dispersed in a liquid carrier material. Liquid toners have many advantages over powder toners. For example, images developed with some liquid toners adhere to the copy substrate without requiring fusing of the image. Other liquid toners require fusing, but require less fuser energy than dry powder toners. Also, liquid toner particles can be made significantly smaller than powder toner particles. This is particularly advantageous in multicolor processes where multiple layers of toner particles generate the final multicolor output image.

SUMMARY OF THE INVENTION

The developability of the liquid toner is the ability of the liquid toner to fully develop the electrostatic latent image on the photoreceptor to a desired image density. It is important to keep the developability constant to maintain print quality. The developability is kept constant by keeping constant the developed mass per unit area (DMA or $M_D$). Conventionally, the developed mass per unit area is determined by developing solid area test patches of a known area on the photoreceptor. A scanning device, or other test device, is used to sense the toner mass density of the test patch. However, if the test patches are not finally transferred to an image media, the test patches place an undesirable load on the cleaning system of the print engine. If the test patches are finally transferred to an image media, their use increases paper waste and reduces printer availability to the customer.

In printing systems that provide custom colors by automating the mixing of primary colored toner components, the component concentrations in the mixed toner bath must be controlled to provide the correct custom color. Methods have been provided for continually sensing the color of the toner bath or the developed layer and calculating component concentrations. These methods are suitable for maintaining color during long runs in the presence of slow changes in developability. However, the use of these methods to obtain the proper initial color often takes several iterations of printing, measuring and proper adjusting of the developed toner color before the first print can be made.

Other conventional methods exist that measure properties of the liquid toner that are related to developability of the liquid toner. However, these methods of characterizing liquid toners are known to have disadvantages.

A first characterization method that measures toner conductivity, is provided by, for example, the Model 610 conductivity meter, sold by Scientifica, 340 Wall St., Princeton, N.J. The conductivity sensor measures the total conductivity of the liquid toner supply. The total conductivity of the liquid toner is a valuable characteristic for two reasons: (1) toners of very low conductivity usually develop very poorly, and (2) as conductivity increases above some optimum value, the developed mass per unit area (DMA) produced by a given voltage differential $\Delta V_{dev}$ between the voltage applied at the photoreceptor $V_{P/R}$ and the voltage applied at the development electrode $V_{dev\ electrode}$ usually decreases. The conductivity of liquid toner supply results from several conductive species and is calculated as:

$$\sigma=\Sigma_{i=1}^{N}\{Q_i{*}N_i{*}\mu_i\}=\Sigma_{i=1}^{N}\{\sigma_i\} \quad (1)$$

where:

$\Sigma_{i=1}^{N}\{\ldots\}$ denotes the sum from 1 to N of the values of the quantities inside the braces;

$\sigma_i$ denotes the contribution to conductivity from the $i^{th}$ species;

$Q_i$ denotes the charge of the $i^{th}$ species;

$N_i$ denotes the number density of the $i^{th}$ species; and $M_i$ denotes the mobility of the $i^{th}$ species.

Generally, toner particles represent only one of at least two species that contribute to the conductivity of the liquid toner. The particles in liquid toners generally get their charge from a chemical reaction that also produces dissolved molecular species of opposite sign charge. In many practical systems, there are three contributions to conductivity, $\sigma_{particle}$, $\sigma_{minus}$, and $\sigma_{plus}$, where:

$\sigma_{particle}$ denotes the particle contribution to conductivity;

$\sigma_{minus}$ denotes the negatively charged molecules' contribution to conductivity; and $\sigma_{plus}$ denotes the positively charged molecules' contribution to conductivity.

Conductivity alone is not able to identify systems in which dissolved molecules provide a large conductivity and particles are poorly charged. Nor can conductivity alone distinguish a small number of particles with high charge and mobility from a large number of particles with low charge and low mobility.

A second characterization method, laser velocimetry, usually called electrostatic light scattering (ELS), measures the velocities of toner particles. This has been described by Caruthers et al., "Liquid Toner Particle Charging and Charge Director Ionization," pages 210–214, IS&T's $10^{th}$ *International Congress on Advances in Non-Impact Printing Technologies* (1994). Knowing the applied electrical field and the velocity, the toner particle mobility can be calculated. Liquid toners with high particle mobilities generally produce better print quality than toners with low particle mobilities. However, electrostatic light scattering requires very dilute solutions of the toner, such as 0.01% toner particles by weight, so that light is not multiply scattered in passing through the toner. Because this is much less than the 1–2% concentration of toner particles used in most printing engines, the mobilities measured by electrostatic light scattering may not predict the mobilities of toner particles in the printing engine's toner supply. Also, electrostatic light scattering requires that toner particles not move in and out of the laser beam during the measurement. For very mobile toner particles, this may require that the applied electric fields be much less than those used in a printing engine's development system. If the toner particle's mobility is field-dependent, then electrostatic light scattering may again fail to correctly predict behavior in the printing engine's development system.

A third method of characterization measures the intensity of an acoustic wave induced in a liquid toner by application of a high frequency electric field. Matec Applied Sciences' Electrokinetic Sonic Amplitude (ESA) system uses this principle. This characterization method has the great advantage of working well at high particle concentrations. However, as the density difference between the particle and the carrier liquid decreases, the signal becomes weaker. Since particles remain dispersed in the carrier liquid better as their density becomes more equal to the carrier liquid's density, this method may also fail for systems of practical importance.

All the above methods have the disadvantage that they measure properties of the liquid toner that are related to developability of the liquid toner, but they do not directly measure developability. Also, the conventional methods do not use the same development geometry used in the printing engine. Thus, none of the methods provide an accurate measurement of the developability of liquid toner.

This invention provides systems and methods that measure a developed mass per unit area of the liquid toner.

This invention provides systems and methods that directly measure a developed mass per unit area of the liquid toner.

This invention separately provides systems and methods that measure liquid toner developability under conditions which approximate those of a development system without needing to print test patches on the photoreceptor or image media.

This invention separately provides for systems and methods that set up a specified ratio of toner components in a multi-component toner without having to take several iterations of printing, measuring and correcting the developed toner color before the first print is made.

In various exemplary embodiments, the toner developability sensor according to this invention includes a power supply, a first electrode having at least one surface in contact with the liquid ink and connected to the power supply, a second electrode having at least one surface in contact with the liquid ink and spaced from the first electrode, and a sensor. When a potential difference is applied between the first and second electrodes, a developed toner layer is formed on the first electrode. The sensor senses at least one characteristic of the developed toner layer formed on the first electrode.

In various exemplary embodiments of the toner developability sensor according to this invention, the first electrode is one wall of an ink tank containing the liquid ink. The second electrode is immersed in the liquid ink contained in the ink tank. The sensor is positioned outside of the ink tank.

In various other exemplary embodiments of the toner developability sensor according to this invention, the first electrode is one wall of a container immersed in the liquid ink and the second electrode is immersed in the liquid ink. In this exemplary embodiment, the sensor is located within the container.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
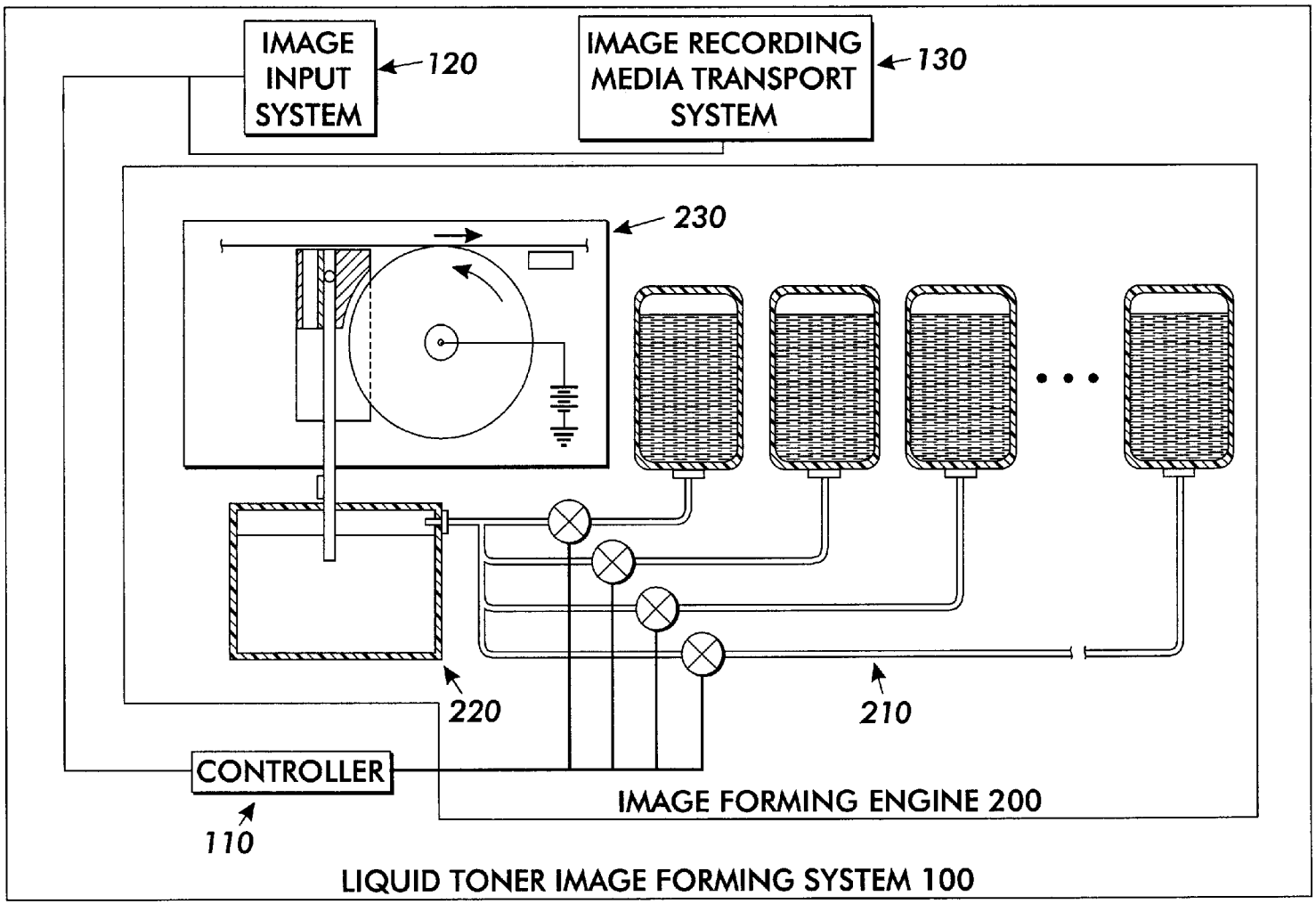
FIG. 1 shows one exemplary embodiment of a printer incorporating one exemplary embodiment of the toner developability sensor according to this invention.

FIG. 1 illustrates one exemplary embodiment of a printer incorporating one exemplary embodiment of the toner developability sensor according to this invention.

As shown in FIG. 1 a liquid toner image forming system 100 includes a multi-color image forming engine 200. It should be appreciated that the systems and methods of this invention can equally be applied to any other type of print engine that generates electrostatic latent images and uses liquid toners to develop the electrostatic liquid images. These other types of print engines include laser printers and full width light emitting element print bars that include photoreceptors, raster output scanner printers, analog copiers and digital copiers that include photoreceptor belts or drums, and any other known or later developed single-color, highlight-color or full-color electrophotographic, electrographic or ionographic print engine, or any other known or later developed electrostatic image forming print engine.

As shown in FIG. 1, the image forming engine 200 includes an ink supply system 210 that supplies liquid ink to the ink reservoir 220. A controller 110 regulates the amount of liquid ink delivered to the ink reservoir 220 from the ink supply system 210. An image receiving media transport system 130 transports image receiving media, such as paper, through the image forming engine 200. Specifically, the image receiving media transport system 130 transports the image receiving media towards and away from the image development system 230. The image development system 230 uses ink from the ink reservoir 220 to develop a latent image, where the latent image has been formed based on the information from the image input system 120. The developed image is then transferred to the image receiving media to form a developed image.

Figure 2:
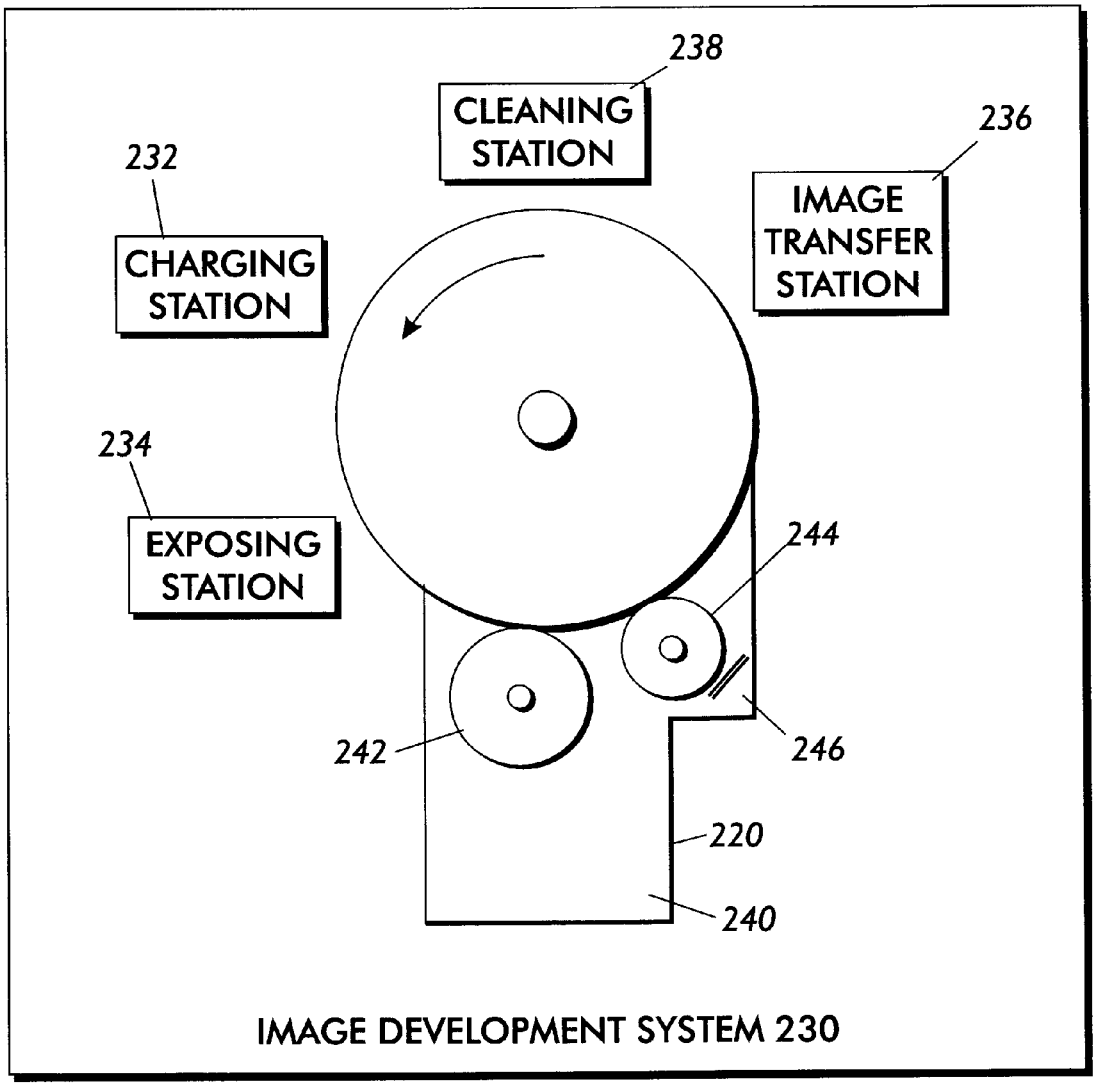
FIG. 2 shows one exemplary embodiment of the image development system of this invention.

FIG. 2 shows one exemplary embodiment of the image development system 230. As shown in FIG. 2, the image development system 230 includes a photoreceptor drum 231, a charging station 232, an exposing station 234, an image transfer station 236, a cleaning station 238, and a developer station 240 arranged circumferentially around the photoreceptor drum 231. The photoreceptor drum 231 is substantially uniformly charged at the charging station 232. Exposing the charged photoreceptive drum 231 to a light image at the exposing station 234 discharges selective areas of the charged photoreceptive drum 231, creating an electrostatic latent image on the photoreceptive drum 231 corresponding to the original input document or signal. This latent image is subsequently developed into a developed, or visible, image by supplying liquid ink to the latent image formed on the surface of the photoreceptor drum 231 as the photoreceptor drum 231 rotates past the developer station 240. The developed image is subsequently transferred from the photorecepor drum 231 to an image receiving medium at the image transfer station 236, either directly or via an intermediate transfer device. Once the developed image is transferred to the image receiving medium, any remaining toner particles are removed from the photorecepor drum 231 at the cleaning station 238.

The developer station 240 includes the ink reservoir 220. A development roll 242, a metering roll 244, and a scraper blade 246 are provided in the ink reservoir 220. The peripheral surface of the development roll 242 is placed close to the surface of the photoreceptor drum 231. The development roll 242 rotates in the same direction as the direction of rotation of the photoreceptor drum 231 and carries toner to the surface of the photoreceptor drum 231. The electrically-biased metering roll 244 is provided in the ink reservoir 220 next to the development roll 242. The peripheral surface of the metering roll 244 is placed close to the surface of the photoreceptor drum 231. The metering roll 244 rotates in the opposite direction of rotation to the photoreceptor drum 231 to apply a substantial shear force to the thin layer of liquid ink between the metering roll 244 and the photoreceptor drum 231. This controls the thickness of the liquid ink on the surface of the photoreceptor drum 231. The scraper blade 246 is also provided in the ink reservoir 220 next to the metering roll 244. The scraper blade 246 cleans toner particles from the metering roll 244. In alternative development systems, the development roll may be replaced by a fixed development electrode. When the curvature of the fixed development electrode parallels the photoreceptor, the fixed development electrode is sometimes called a shoe.

Figure 3:
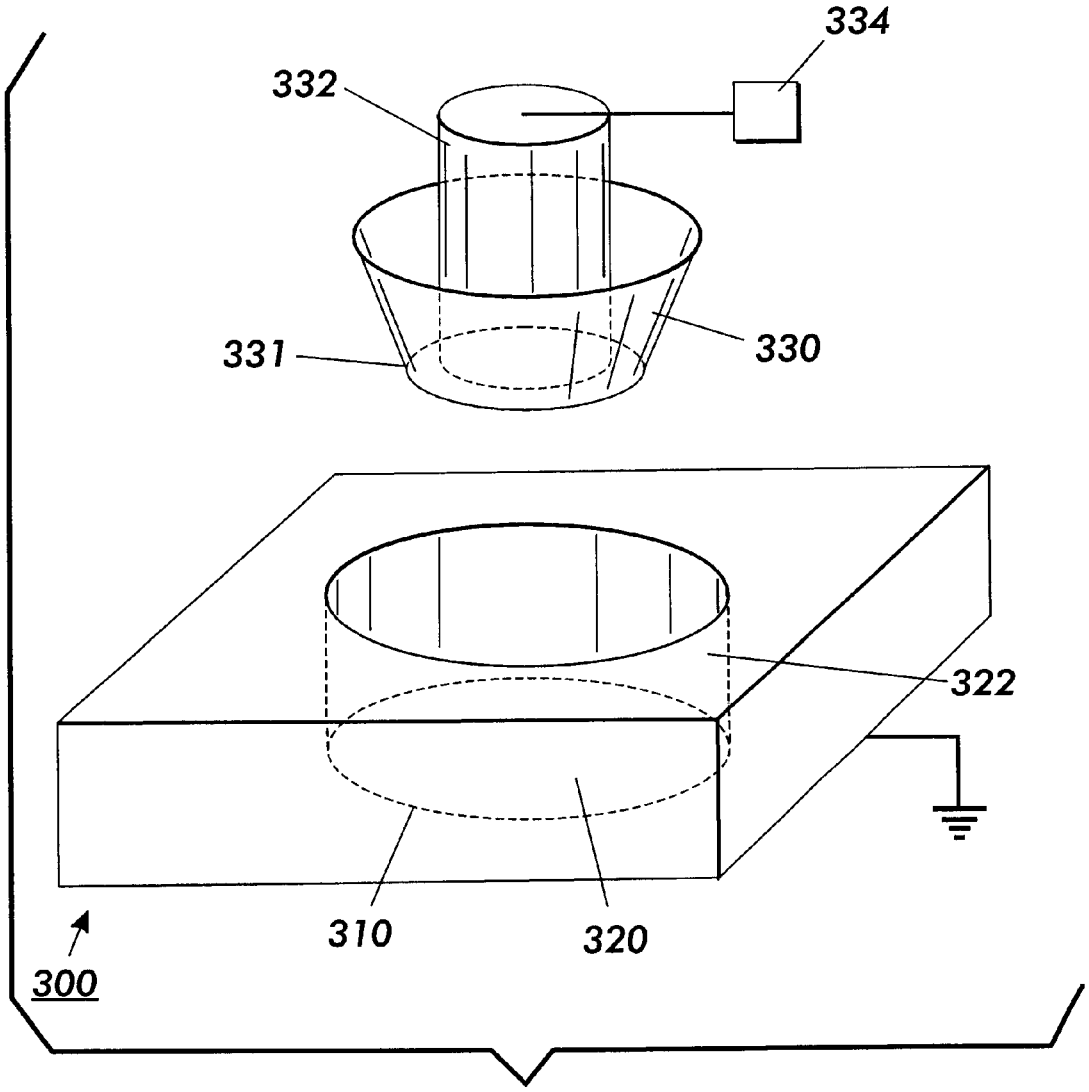
FIG. 3 shows a conventional plate-out cell on which the toner developability sensor and sensory method according to this invention is based.

FIG. 3 illustrates a conventional plate out cell on which the toner developability sensor and sensory method according to this invention are based. As shown in FIG. 3, a standard plate-out cell 300 includes a grounded metal block 310. A cylindrical reservoir 320 is formed in the metal block 310. A number of insulating support posts 322 are formed or placed into the reservoir 320. A weighing pan 330 is placed on top of the insulating posts 322, such that a plate out surface 331 of the weighing pan 330 contacts the top of the liquid toner in the reservoir 320. An electrode 332 is placed in the weighing pan 330 and connected to a power supply 334.

A voltage V is then applied to the electrode 334 for a plate out time t. As a result, the toner particles suspended in the liquid toner "plate out" onto the plate out surface 331. Current from the power supply 334 is integrated during the plate out time t to determine the plate out charge q applied to the weighing pan 330. The weighing pan 330 is weighed before and after the toner particles are plated out of the liquid toner on to the plate out surface 331. The difference is the plate out mass M of the toner particles plated out onto the plate out surface 331. The charge to mass ratio q/M provides an estimate of toner particle charge.

The toner developability sensor and sensing method of this invention includes two electrodes provided with separate electric potential. The separation between the two electrodes is representative of the development gap used in the image development system 200. For liquid xerographic development systems, the development gap is typically 0.002–0.020 inch. The electrodes can be any convenient shape, including parallel plates and concentric cylinders.

Figure 4:
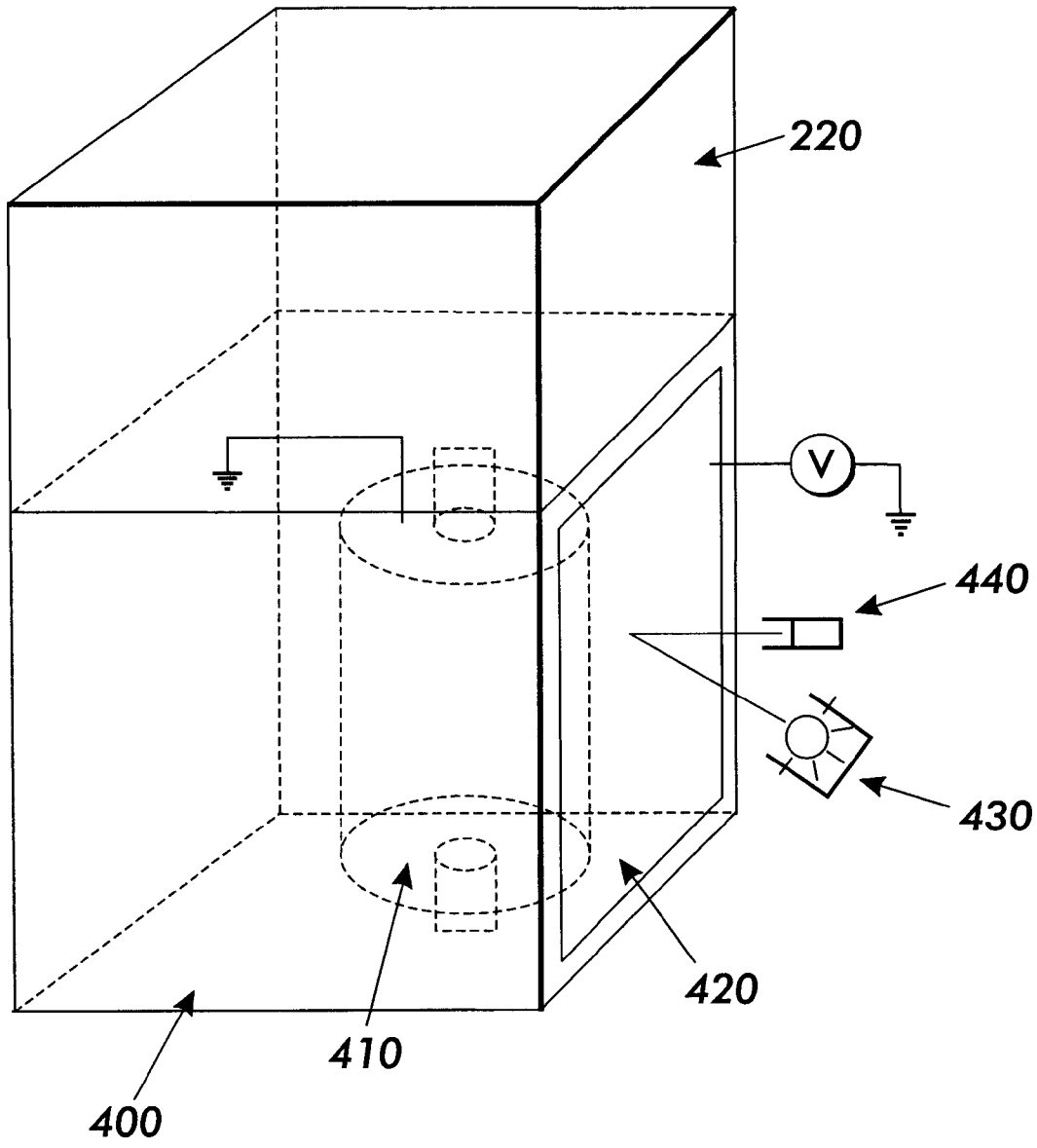
FIG. 4 shows one exemplary embodiment of a toner developability sensor according to this invention.

FIG. 4 shows one exemplary embodiment of a toner developability sensor 400 according to this invention. As shown in FIG. 4, the toner developability sensor 400 is located in the liquid ink reservoir 220. The toner developability sensor 400 includes a first cylindrical electrode 410. The cylindrical electrode 410 is electrically grounded and powered by a motor (not shown) connected to a central shaft of the cylindrical electrode 410. The first cylindrical electrode 410 is spaced from a second planar electrode 420. The second planar electrode 420 forms one wall of the liquid ink reservoir 220.

Standard high voltage power supplies can be used with a timing circuit to apply a voltage, V, to the second electrode 420. The polarity of the voltage V is chosen so that toner is developed onto the second electrode 420. Between measurements, both electrodes 410 and 420 can be kept at the same voltage to keep the electrodes 410 and 420 free of toner. If necessary, a reverse polarity pulse can be applied to the second electrode 420 after the measurement is made to dislodge developed toner off the second electrode 420. Whether active cleaning will be necessary will depend on the properties of the toner and the electrodes 410 and 420.

In various exemplary embodiments, the second electrode 420 is transparent to at least one wavelength of electromagnetic radiation from a light source 430 to which the toner is opaque. Toner developed onto the second electrode 420 is optically sensed using the light source 430 and a light sensor 440. The amount and/or the color of light entering the light sensor 440 changes as toner is developed onto the second electrode 420. The light from the light source 430 is reflected off of toner plated out onto the second electrode 420 and detected by the light sensor 440. The amount of light reflected from the transparent second electrode 420 is measured as the reflectivity, R.

In the exemplary embodiment shown in FIG. 4, the toner developability sensor 400 includes a single light source and light sensor. However, other devices, such as filters, multiple light sources, and/or a monochrometer can be used to sense color variations. The geometry of the light source 430 and the light sensor 440 can be adjusted to measure specular or diffuse reflectance, or both. Either the wavelength of the light absorbed or the light scattered by the toner on the second electrode 420 can be sensed. One suitable sensor output is the ratio of the light scattered by the toner on the second electrode 420 to light absorbed by the toner on the second electrode 420. As the toner concentration (TC) goes up, the ratio of the light scattered by the toner on the second electrode 420 to the light absorbed by the toner on the second electrode 420 goes up.

The developed mass per unit area DMA can also be sensed by variations in the vibrational modes of the second electrode 420. These vibrations will be damped by the liquid ink in which the sensor is immersed. At usual solids concentrations ($1\% \leqq TC \leqq 3\%$), the density and viscosity of the toner is nearly that of the pure carrier fluid and very weakly dependent on changes in the toner concentration (TC). Vibrational modes, therefore, can be made to directly or directly correlate with the developed mass per unit area (DMA). Any suitable vibration causing device, such as a piezoelectric vibrator 450, can be used to vibrate the second electrode 420 before and after the toner is developed on to the second electrode 420. Any suitable sensor, such as an accelerometer 460, can be used to measure the vibrational modes of the second electrode 420 before and after the toner is developed on to the second electrode 420. The developed mass per unit area can then be calculated based on the difference between the vibrational modes of the second electrode 420 before the toner is developed on to the second electrode 420 and the vibrational modes of the second electrode 420 after the toner is developed on to the second electrode 420.

Figure 5:
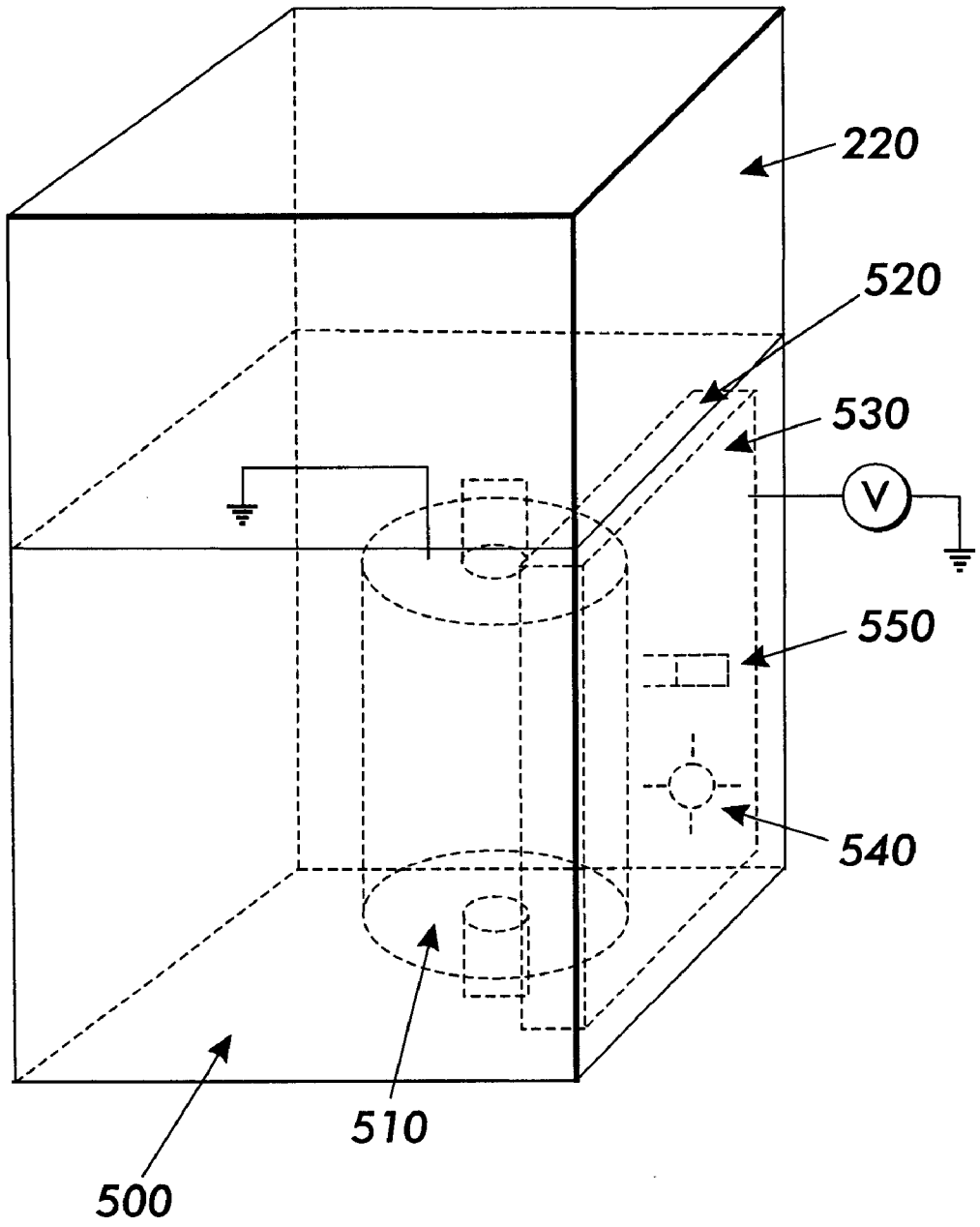
FIG. 5 shows a second exemplary embodiment of a toner developability sensor according to this invention.

FIG. 5 shows a second exemplary embodiment of a toner developability sensor 500 according to this invention. In particular, as shown in FIG. 5, the toner developability sensor 500 is placed in the liquid ink reservoir 220. The toner developability system 500 includes a cylindrical first electrode 510. The cylindrical first electrode 510 is spaced from a planar transparent (in the same way the electrode 420 is transparent) second electrode 520, which forms one wall of a sealed box. The cylindrical first electrode 510 is grounded and is turned by a motor (not shown) connected to a central shaft of the cylindrical first electrode 510. When a voltage V is applied to the second electrode 520, toner is developed on to the planar second electrode 520. A light source 540 and a light sensor 550 are provided in the box 530. The light source 540 directs light towards the developed toner developed onto the transparent planar second electrode 520.

The toner developability sensor 500 shown in FIG. 5 is completely self-contained in the liquid ink reservoir 220. The toner developability sensor 500 can be taken out of the liquid ink reservoir 1230 and used in another liquid ink reservoir. The toner developability sensor 500 can also be easily removed for repair and/or cleaning without significant manipulation of the liquid ink reservoir 220 and other components of the developer station 230.

The amount of light reflected from the transparent second electrode 420 or 520 will decrease as more toner is developed onto the transparent second electrode 420 or 520. The relationship between the developed mass per unit area DMA and the reflectivity R depends on the type of pigment used in the toner and the weight fraction of pigment in the toner particles. However, the relationship between the developed mass per unit area DMA and the reflectivity R does not depend on the concentration of toner solids in the liquid toner supply, the mobility of the toner particles in the liquid toner supply, or the development field that produces the developed mass per unit area DMA and the reflectivity R. Therefore, the control system can keep the developed mass per unit area DMA at its target value by keeping the reflectivity R at its target value.

Instead of measuring the developed mass per unit area DMA directly, the actual printed color could be measured, e.g., by measuring the reflective optical density of a specified wavelength of light reflected from the transparent second electrode 420 or 520 to the light sensor 440 or 550. In this case, a relationship is developed between the measured optical density and the resulting color of the toner on the substrate to which the toner is finally transferred. Thus, while subsequent discussions will refer to the control of the developed mass per unit area DMA, it should be understood that this invention applies equally to the control of a final printed color.

For each color of toner, an empirical relationship can be determined between the reflectivity R and the printing engine's developed mass per unit area DMA. That is, a series of voltage differentials $\Delta V_{dev}{}^{i}$ can be applied to the toner developability sensor 400 or 500. The same series of voltage differentials $\Delta V_{dev}{}^{i}$ are used in the development system. The reflectivities $R^{i}$ are measured by the toner developability sensor 400 or 500 and the resulting developed mass per unit areas $DMA^{i}$ are measured after development. A curve of the developed mass per unit area DMA vs. the reflectivity R is determined and the target value of the reflectivity R is the value that corresponds to the target developed mass per unit area. The controller 110 is provided with the reflectivity R vs. the developed mass per unit area DMA curve. The target developed mass per unit area DMA can then be changed and the control system will know the appropriate target value of the reflectivity R.

Having determined the relationship between the developed mass per unit area DMA and the reflectivity R, changes in the developability of the toner can be calibrated. That is, using methods described below, the toner developability is calculated for toner having the target values of toner solids concentration (TC) and toner conductivity σ. Changes in the toner developability can then be calculated as uncharged toner concentrate and/or charge director solution are added to the ink reservoir 220. In this way, empirical relations are determined which can enable the controller 110 to adjust the toner developability by adding toner concentrate or charge director solution to the ink reservoir 220.

As discussed above, the system and methods of this invention can be practiced by using empirically or theoretically determined relations between the developed mass per unit area DMA and the reflectivity R of the electrode plus developed toner. Two examples of the use of approximate theoretical relationships are set forth below.

EXAMPLE 1

In a single component toner, the reflectivity R decreases approximately exponentially with the developed mass per unit area DMA:

$$R \cong \mathrm{Exp}[-\alpha^{*}\mathrm{DMA}] \tag{2}$$

$$R \cong \mathrm{Exp}[-\alpha^{*}\mathrm{developability}^{*}TC^{*}\Delta V_{dev}] \tag{3}$$

where:

TC is the toner concentration;

α is a constant dependent on the wavelength of the light and the color of the toner;

"developability" is the developability of the toner; and $\Delta V_{dev}$ is the voltage differential.

When a new toner bath is made up, the toner concentration TC is measured using concentration sensors that are well known in the patent literature. The reflectivity R is measured for one value of the voltage differential $\Delta V_{dev}$ typical of the printing engine's development system. The value for "α*developability" is calculated as follows:

$$\alpha^{*}\mathrm{developability} \cong -Ln[R]/(TC^{*}\Delta V_{dev}) \tag{4}$$

If the value of "α*developability" measured by this method deviates from a target value by more than a specified tolerance, then charge director solution or uncharged toner concentrate may be added to the ink reservoir 220 to change the developability of the toner, according to relations determined empirically for each toner.

In various exemplary embodiments, when a new toner bath is made up, the toner concentration TC is measured using concentration sensors that are well know in the patent literature. A number N of voltage differentials $\Delta V_{dev}{}^{i}$ are applied. The resulting reflectivities $R^{i}$ are measured. Then, "α*developability" is calculated for each i.

In various exemplary embodiments, "α*developability" is determined using the known least squares method, to minimize the root mean square error "RMS error":

$$RMS\ \mathrm{Error} = \mathrm{Sqrt}[(1/N)^{*}\Sigma_{i=1}{}^{N}\{R^{1} - \mathrm{Exp}[-\alpha^{*}\mathrm{Developability}^{*}TC\Delta V_{dev}{}^{i}]\}^{2}] \tag{5}$$

In various other exemplary embodiments, the controller 110 periodically checks the developability of the toner by applying the same voltage differential $\Delta V_{dev}$ being used by the developer station 240 and measuring the resulting reflectivity R. If the resulting reflectivity R deviates from the target value, the controller 110 adjusts the voltage differential $\Delta V_{dev}$ to bring the reflectivity R back to its target value. If the reflectivity R is below its target value, the developed mass per unit area DMA is above its target value and the voltage differential $\Delta V_{dev}$ must be reduced. Conversely, if the reflectivity R is above its target value, the developed mass per unit area DMA is below its target value and the voltage differential $\Delta V_{dev}$ must be increased. Such adjustments may be necessary because of variations in the concentration or developability of the toner particles in the liquid toner development supply.

If a toner concentration sensor shows that toner concentration TC has changed from its target value, then "α*developability" and Eq. (3) can be used to find a correct new value of the voltage differential $\Delta V_{dev}$. However, if a toner concentration sensor shows that the toner concentration TC is at its target value, then developability has changed and equations (4) or (5) should be used to determine a new value for "α*developability" and a new value for the voltage differential $\Delta V_{dev}$. In each of these cases, the new value for the voltage differential $\Delta V_{dev}$ can be used by the marking engine's control program or control system or circuitry to change the potential applied to the development roll and to keep the actual developed mass and color at or near target values.

EXAMPLE 2

In a multi-component developer, the color of the reflected light depends on the ratio of components developed onto the transparent electrode.

$$R(\lambda) \cong \mathrm{Exp}[-\Sigma_j \alpha_j(\lambda)^* DMA_j] \quad (6)$$

In this case, the reflectivity spectra (e.g., R at each of a series of light wavelengths, λ) should be measured for a series of $\Delta V_{dev}$:

$$R^i(\lambda) \cong \mathrm{Exp}[-\Sigma_{j=1}^{M} \alpha_j(\lambda)\ {}^*\mathrm{developability}_j{}^* TC_j{}^* \Delta V_{dev}{}^i],\ I=1,N \quad (7)$$

where:

M is the number of toner components; and

N is the number of light wavelengths.

As in the determination of single-component developability, if N>M, then least squares error minimization is used to determine the "$\alpha_j$* developabilityj" from the measured toner concentrations $TC_j$ and the reflectivities $R^i$, as a new toner supply is made up. The ratios of developabilities are compared to stored values for the target custom color and used to adjust initial target values of the toner concentration $TC_j$. Changes in average developability from a stored value can be used to adjust initial development conditions, including initial voltage differential $\Delta V_{dev}$.

The applied voltage should be chosen so that the applied field approximates the applied field generated by the developer station 240. The electric field used in the toner developability sensor 400 or 500 does not need to be exactly the same as the electric field used in the developer station 240. Similarly, the time interval used during plating out of the toner onto the second electrode 420 or 520 does not need to be exactly the same as the time interval used by the developer station 240 to develop the latent image. This is because developed mass per unit area DMA of the toner can be calculated to a first approximation as:

$$DMA \cong (M_T)(TC)(\mu)(\Delta V_{dev})(t_d)/(g_d) \quad (8)$$

where:

TC is the toner particle concentration, i.e., the mass of the toner particles divided by the total toner mass, which is the sum of the carrier liquid mass, the toner particles mass, and the mass of any additives;

$\Delta V_{dev}$ is the voltage differential;

$\mu$ is the toner particle mobility;

$M_T$ is the toner mass density;

$t_d$ is the development time interval; and $g_d$ is the development gap distance.

Because Eq. (8) is accurate for about 10-fold variations in the electric field, order of magnitude agreement will be sufficient for reliable correlations between the developability determined using the toner developability sensor 400 or 500 and the actual developability of the toner in the developer station 240. This flexibility also allows the toner developability sensor 400 or 500 to have a somewhat different geometry than the developer station 240. For example, the roll and plate electrodes 410 and 420, or 510 and 520, as shown in FIGS. 4 and 5, are easier to keep clean than if the electrodes of the toner developability sensor 400 or 500 were parallel plates. Additionally, by making the first electrode 410 or 510 a cylinder, the toner developability sensor 400 or 500 can be used to measure the developability of the toner in developer systems having many different geometries, such as belt and multiple roll development systems, or belt and shoe development systems.

The toner developability sensor according to this invention can be used in several different ways. For instance, the toner developability sensor according to this invention can be used for feed-forward control of image development. By measuring developability in the liquid ink reservoir, the toner developability sensor according to this invention can predict the development electrode bias needed to develop target developed mass per unit area DMA onto the photoreceptor or electroreceptor. This feed-forward control is valuable at the beginning of a print job after a print machine has been idle for some time. Settling may change the solids concentration actually delivered to the development system. Time may change the chemical equilibria which charge the toner particles. In either case, the toner developability sensor according to this invention measures development of the toner actually circulating in the liquid ink reservoir and can enable printing of the correct color without delays for extensive liquid ink reservoir stirring or for developing and measuring toner on the photoreceptor.

The toner developability sensor according to this invention can also be used to control mixed-toner compositions. By measuring the color of the toner layer actually developed on the development electrode, the toner developability sensor according to this invention provides a more direct control of the toner supply than does optical sensing of the color of the toner. This permits the allowed range of component developabilities which can be used to provide customer-selected custom color liquid xerographic printing to be expanded. This also permits the allowed range of developability variations for the component toners to be expanded. This at least greatly reduces, if not eliminates, the need to print test patches and to measure the color of the test patches on the image receiving media or on the photoreceptor. Such test patches increase waste and/or reduce printer availability to the customer.

The toner developability sensor according to this invention can be used in a printing engine's toner supply, to characterize each batch of toner. The toner developability sensor according to this invention can be used to characterize new liquid electrophotographic toner batches that are made in situ, by the printing engine control program adding toner concentrate, carrier liquid, and/or charge director into an empty reservoir. The toner developability sensor according to this invention can equally well be used to characterize new batches of toner that are added from a premixed combination of toner particles, carrier liquid and chemical additives. As described previously, the print engine controller can calculate the developability of the liquid electrophotographic toner and use this developability to adjust the voltage differential $\Delta V_{dev}$ and control final printed color.

The toner developability sensor according to this invention can be used in a custom color printing engine, to predict the developed color of each batch of multi-component toner. As described above, the reflection spectrum, $R(\lambda)$, of the developed toner can be measured. The printing engine's control system can use empirical or theoretical relations between the toner color and the color of toner on the final substrate to predict the final printed color from the toner color. The printing engine's control system can use this information to make adjustments to the composition of the multi-component toner before making any prints with the toner. In this way the custom color printing engine can guarantee that the first print will have the right color.

The toner developability sensor according to this invention can be used in a printing engine's toner supply, to characterize a batch of toner throughout its life. In some practical systems, the toner is continuously replenished by addition of carrier fluid, toner particle concentrate, and/or charge director solution, so that the toner supply can be used to make many more prints than could be made from the amount of toner initially in the toner supply vessel. As discussed previously, the developability of a liquid electrophotographic toner can vary with time. Depending on the design and use of a particular liquid electrophotographic toner, such variations can be caused by changes in environment (temperature, relative humidity), contamination from the substrate to which the toner is transferred (paper fiber, oils, surface agents), or from other factors that may remain unknown to the designers of the liquid electrophotographic toner and its printing engine.

The toner developability sensor according to this invention may be useful with many different toner designs and with many different printing systems that use liquid electrophotographic toner. No matter what the origins of the changes in developability, the toner developability sensor according to this invention can measure the current developability. The printing engine's control system can adjust the voltage differential $\Delta V_{dev}$ to try to maintain constant print color. Alternatively, the printing engine's control system can add toner components (carrier liquid, toner particle concentrate, charge director solution, and/or other materials) to try to bring the toner's developability back to its target value. Finally, if the printing engine's control system is not able to adjust the voltage differential $\Delta V_{dev}$ or correct developability, the control system can signal the user that the liquid electrophotographic toner supply must be replaced.

The toner developability sensor according to this invention can be used in various pieces of scientific test equipment to measure important properties of liquid electrophotographic toners. A variable power supply can be used to change the value of the voltage differential $\Delta V_{dev}$. Timing elements can be used to vary the time over which $\Delta V_{dev}$ is applied. Positioning elements can be used to vary the spacing between the cylindrical electrode and the planar electrode. Variable speed motors can be used to change the rotational speed of the cylindrical electrode. Heating and/or cooling elements can be used to control the temperature of the liquid electrophotographic toner supply. Stirring elements can be used to control the agitation of the liquid electrophotographic toner supply. All of the above elements can be individually controlled or controlled by a computer program.

A liquid electrophotographic toner concentration sensor according to this invention can be added to the liquid electrophotographic toner supply to sense the ratio of toner particles to carrier liquid. A toner conductivity sensor according to this invention can be added to the liquid electrophotographic toner supply to sense the electrical conductivity of the toner. Other chemical sensors can be added to the liquid electrophotographic toner supply to sense water content of the toner or various impurities in the toner. The outputs of all these sensors can be individually displayed, printed, or stored in a computer. The output of the optical sensor can be displayed, printed or stored in a computer memory.

It will usually be advantageous to use a control system, such as a computer, for control, for storage of all sensor results, and for correlation of results with experimental conditions. This facilitates quantitative calculations, such as developed mass per unit area DMA from optical reflectivity, the toner developability from the developed mass per unit area DMA and the voltage differential $\Delta V_{dev}$, etc. In this way, all the determinations previously described can be repeatedly performed and the results displayed and stored.

One independent advantage of using the toner developability sensor according to this invention to measure properties of liquid toner is that optical reflectivity is easy to measure and very directly related to the measured properties of the liquid toner. Another independent advantage of this use of the toner developability sensor according to this invention is that variables that may change toner developability can be individually varied to identify their effects in detail. Another independent advantage of this use of the toner developability sensor according to this invention is that several variables can be changed simultaneously to identify interactions between the variables. Another independent advantage of this use of the toner developability sensor according to this invention is that experiments can be repeated at different times. It is well known that variations in the results of repeated experiments with experimentally controlled variables provide valuable information about variation in printing engine performance and also show that unidentified variables effect toner performance.

It should be understood that the above uses are not exclusive and the present invention includes all uses of the toner developability sensor.

Thus, while this invention has been described in conjunction with the specific exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A toner developability sensor that measures toner developability of a liquid ink contained in an ink tank, the liquid ink comprising toner particles suspended in a carrier medium, comprising:

a power supply;

a first electrode having at least one surface in fixed contact with the liquid ink in the ink tank and connected to the power supply;

a second electrode disposed in the ink tank and having at least one surface in contact with the liquid ink and spaced from the first electrode, wherein, when a potential difference is applied between the first and second electrodes, a developed toner layer is formed on the first electrode; and a sensor that senses at least one characteristic of the developed toner layer formed on the at least one surface of the first electrode.

2. The toner developability sensor of claim 1, wherein the first electrode is transparent at a wavelength, the toner being opaque at the wavelength.

3. The toner developability sensor of claim 1, wherein the first electrode is planar and the second electrode has a curved surface.

4. The toner developability sensor of claim 1, wherein the first electrode is a plate.

5. The toner developability sensor of claim 1, wherein the second electrode is a cylinder.

6. The toner developability sensor of claim 1, wherein:

the first electrode is one wall of an ink tank containing the liquid ink; and the second electrode is immersed in the liquid ink contained in the ink tank.

7. The toner developability sensor of claim 6, wherein the sensor is positioned outside of the ink tank.

8. The toner developability sensor of claim 1, wherein:

the liquid ink is contained in an ink tank;

the first electrode is one wall of a container immersed in the liquid ink; and the second electrode is immersed in the liquid ink.

9. The toner developability sensor of claim 8, wherein the sensor is located within the container.

10. The toner developability sensor of claim 1, wherein the sensor includes a light source and a light detector.

11. The toner developability sensor of claim 1, wherein the sensor includes:

a vibration generator that vibrates the first electrode; and a vibration detector usable to measure vibrations of the first electrode, wherein the vibration of the first electrode depends at least on part of an amount of toner developed on the first electrode.

12. A liquid ink image forming system, comprising:

an image forming engine, comprising:

a photoreceptor member;

a charging station that charges the photoreceptor member;

an exposure station that creates a latent image on the charged photoreceptor member;

a developer station that supplies liquid ink to the exposed photoreceptor member to develop the latent image into a developed image, the liquid ink comprising toner particles suspended in a carrier medium;

a liquid ink reservoir that contains the liquid ink supplied by the developer station to the exposed photoreceptor; and a toner developability sensor, comprising:

a first electrode connected to a voltage source, the first electrode having at least one surface in fixed contact with the liquid ink;

a second electrode immersed in the liquid ink in the liquid ink reservoir and spaced from the first electrode, wherein, when a potential difference is applied between the first and second electrodes, a developed toner layer is formed on the at least one surface of the first electrode; and a sensor that senses at least one characteristic of the developed toner layer formed on the at least one surface of the first electrode that is representative of a developability of the liquid ink.

13. The liquid ink image forming system of claim 12, wherein the first electrode is planar and the second electrode is curved.

14. The liquid ink image forming system of claim 12, wherein the first electrode forms at least a portion of one wall of the liquid ink reservoir.

15. The liquid ink image forming system of claim 14, wherein the sensor is outside of the liquid ink reservoir.

16. The liquid ink image forming system of claim 12, wherein the first electrode forms at least a portion of one wall of a container immersed in the liquid ink reservoir.

17. The liquid ink image forming system of claim 16, wherein the sensor is located within the container.

18. The liquid ink image forming system of claim 12, wherein the toner developability sensor includes a light source that directs light to the first electrode, and a light sensor that detects the at least one characteristic of light received from the first electrode.

19. The liquid ink image forming system of claim 18, wherein the at least one characteristic of the light detected by the light sensor from the first electrode is the reflectivity of the light.

20. A method for sensing toner developability in an ink reservoir of a liquid ink image forming system, the liquid ink image forming system comprising a first electrode and a second electrode, a surface of the first electrode and a surface of the second electrode being in fixed contact with the liquid ink in the ink reservoir, the method comprising:

applying a potential difference between the surface of the first electrode and the surface of the second electrode so that toner particles are collected from the liquid ink on the surface of the second electrode; and sensing at least one characteristic of the toner particles collected on the surface of the second electrode, the step of sensing comprising:

directing electromagnetic radiation onto another surface of the second electrode and through the second electrode;

directing the electromagnetic radiation from the toner particles collected on the surface of the second electrode and back through the second electrode and onto a sensor sensitive to the electromagnetic radiation; and generating at least one signal representative of at least one characteristic of the sensed electromagnetic radiation, the at least one characteristic of the sensed electromagnetic radiation indicative of a developability of the liquid ink.

21. The method for sensing toner developability of claim 20, wherein the at least one characteristic of the sensed electromagnetic radiation is the reflectivity of the sensed electromagnetic radiation.

22. A liquid ink image forming system, comprising:

an image forming engine, comprising:

a photoreceptor member;

a charging station that charges the photoreceptor member;

an exposure station that creates a latent image on the charged photoreceptor member;

a developer station that supplies liquid ink to the exposed photoreceptor member to develop the latent image into a developed image, the liquid ink comprising toner particles suspended in a carrier medium;

a liquid ink reservoir that contains the liquid ink supplied by the developer station to the exposed photoreceptor; and a toner developability sensor, comprising:

a first electrode connected to a voltage source, the first electrode having at least one surface in fixed contact with the liquid ink;

a second electrode immersed in the liquid ink in the liquid ink reservoir and spaced from the first electrode, wherein, when a potential difference is applied between the first and second electrodes, a developed toner layer is formed on the at least one surface of the first electrode; and a sensor that vibrates the first electrode and that senses vibrations of the first electrode, wherein the vibration of the first electrode depends at least on part of an amount of toner developed on the at least one surface of the first electrode.

23. The liquid ink image forming system of claim 22, wherein the sensor includes a vibrator that vibrates the first electrode and a vibration sensing device that senses the vibration of the first electrode.

24. The liquid ink image forming system of claim 23, wherein the vibrator is a piezoelectric vibrator.

25. The liquid ink image forming system of claim 23, wherein the vibration sensing device is an accelerometer.

* * * * *